US005358372A

United States Patent [19]

Meredith

[11] Patent Number: 5,358,372

[45] Date of Patent: Oct. 25, 1994

[54] SHEET BLOCK INVERTER

[75] Inventor: Craig E. Meredith, Valleyford, Wash.

[73] Assignee: Thermoguard Equipment, Inc., Spokane, Wash.

[21] Appl. No.: 89,885

[22] Filed: Jul. 8, 1993

[51] Int. Cl.[5] ..... B65H 1/00

[52] U.S. Cl. ..... 414/778; 414/773; 414/742; 414/743; 414/779

[58] Field of Search ..... 414/732, 738, 758, 773, 414/796.4, 742, 743, 778, 779

[56] References Cited

U.S. PATENT DOCUMENTS

| | | | |
|---|---|---|---|
| 2,674,386 | 4/1954 | Larson | 414/742 |
| 2,706,623 | 4/1955 | Styes | 414/743 X |
| 2,756,881 | 7/1956 | Sims | 414/743 X |
| 3,617,054 | 11/1971 | Schilling | 414/732 X |
| 4,618,054 | 10/1986 | Muller | 271/157 X |

FOREIGN PATENT DOCUMENTS

| | | | |
|---|---|---|---|
| 1203869 | 1/1960 | France | 414/743 |
| 175644 | 10/1982 | Japan | 414/758 |

OTHER PUBLICATIONS

Photographs and sketch of a sheet block inverter produced by ASC Machine Tools of Spokane, Wash. on a date believed to be prior to Jul. 8, 1992.

*Primary Examiner*—Michael S. Huppert
*Assistant Examiner*—Janice Krizek
*Attorney, Agent, or Firm*—Wells, St. John, Roberts, Gregory & Matkin

[57] ABSTRACT

A sheet block inverter is described in which successive blocks of sheets received along an infeed plane are successively inverted prior to being received on a discharge conveyor. A sheet block receiving magazine receives a sheet block along the infeed plane. A magazine pivot driver then pivots the sheet block through an angle about a second axis of less than 180°, leaving the block nearly inverted and upwardly inclined. The magazine is mounted to a magazine inverter yoke, which in turn is pivotably mounted to a discharge conveyor. The inverter yoke and magazine are then pivoted by an inverter yoke pivot driver about a first axis to a discharge station where the discharge conveyor receives the block. The discharge conveyor is mounted for elevational adjustment about an axis that is coaxial with the first axis.

11 Claims, 5 Drawing Sheets

SHEET BLOCK INVERTER

TECHNICAL FIELD

The present invention relates to inverters for blocks of sheet material such as cardboard carton blanks received from an infeed device.

BACKGROUND OF THE INVENTION

Bulk sheet handling equipment is used for sequentially separating large bulk quantities of sheet materials such as corrugated container blanks or other stacks of sheet materials into smaller, more manageable size "blocks" for further handling. Often the blocks need to be inverted for further processing.

Machinery developed for inverting sheet blocks, until advent of the present invention, has been found inadequate. Such machinery may spill the blocks of sheet material, leaving an untidy, unmanageable block after the inversion step. This is due in part to the fact that inversion requires a 180° rotation of the blocks, and the older machinery was designed to complete the full rotation in one arcuate movement. The impetus of the block during rotation could cause the block to be propelled from the inversion device. This is especially true if the inversion device is to be operated at a rate commensurate with the operating speeds of the remaining handling machinery.

Another problem found with existing inversion machinery is that the discharge end of the downstream discharge conveyor (receiving the sheet blocks) must usually be adjustable to enable discharge of the blocks at different elevations. To accomplish such adjustment, the downstream discharge conveyor is usually pivoted at its infeed end. The prior inversion devices typically pivot on an axis different than the rotational axis of the sheet discharge conveyor. While one setting of the downstream discharge conveyor may properly coincide with the 180° rotation of the inversion device, other settings will require similar adjustment of the inversion device to accommodate the new downstream discharge conveyor elevation. This causes complexity in adjustment of the inversion device rotation angle, and consequent down time while such adjustments are made.

A need has therefore been realized for an inversion device that will function reliably to consistently rotate sheet blocks without spilling the blocks onto the downstream discharge conveyor.

A need has also been realized for an inversion device that will operate at speeds commensurate with other associated handling machinery along the flow path of the sheet material.

A still further need has been recognized for an inversion device that will automatically accommodate itself to elevational adjustments of the downstream discharge conveyor without requiring complex, time consuming adjustment of either mechanism.

BRIEF DESCRIPTION OF THE DRAWINGS

A preferred embodiment of the invention is described below with reference to the accompanying drawings, which are briefly described below.

FIG. 5 is a view similar to FIG. 4 only showing the discharge conveyor and the inverter set at a different discharge angle.

DETAILED DESCRIPTION OF THE PREFERRED EMBODIMENTS

This disclosure of the invention is submitted in furtherance of the constitutional purposes of the U.S. Patent Laws "to promote the progress of science and useful arts" (Article 1, Section 8).

Figure 1:
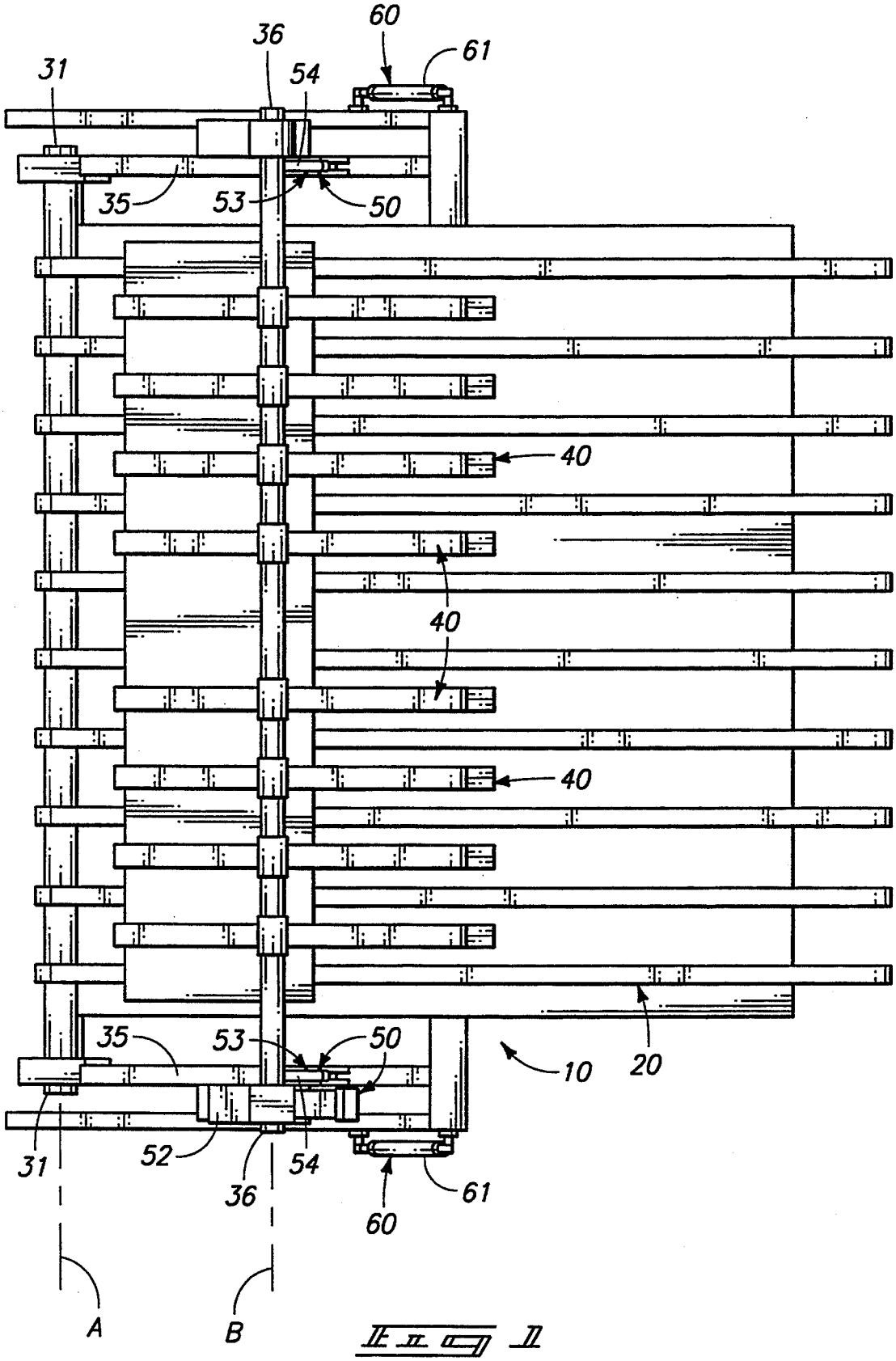
FIG. 1 is a top plan view of the present sheet block inverter and a discharge conveyor.
Figure 2:
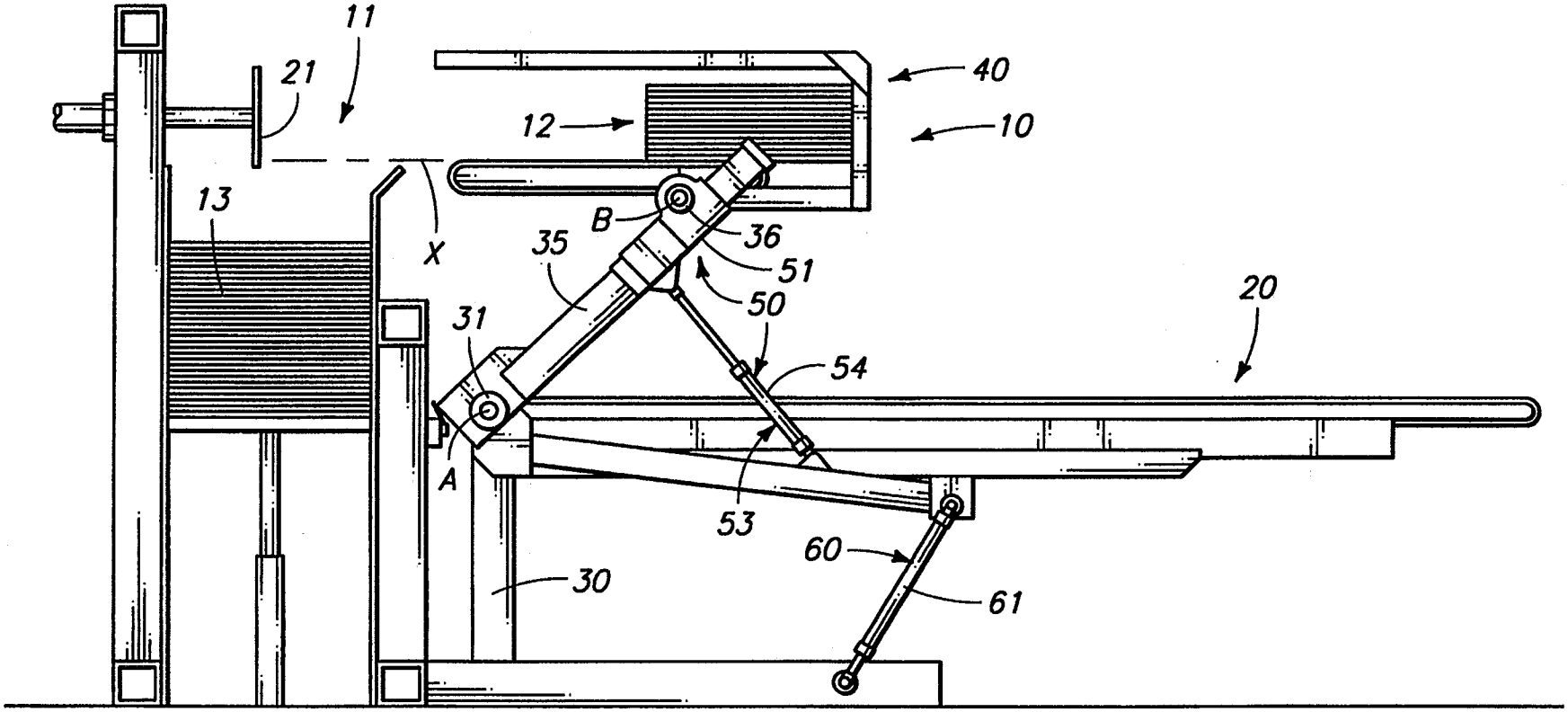
FIG. 2 is a side elevation view of the sheet block inverter (in a sheet block receiving position), the discharge conveyor, and an upstream block feeding mechanism.

Referring now in greater detail to the drawings, a preferred form of the present sheet block inverter is shown in FIG. 2 by the reference numeral 10. The inverter 10 is shown adjacent a sheet block infeed device 11 which is not part of the present invention, but which is shown to lend a better understanding of the environment in which the present inverter operates. The infeed device may be any of several such devices currently in use commercially to deliver individual blocks 12 of sheet material from a larger block of sheets 13.

The present inverter 10 is also shown in conjunction with a sheet block discharge conveyor 20, which may be provided together with the inverter.

For descriptive purposes, the infeed device is shown to include a block pusher 21, used to push successive sheet blocks 12 from the stack 13 along an infeed plane "x" that is typically horizontal. The stack of sheets is indexed upwardly after each operation of the pusher 21, bringing a fresh block of sheets into the path of the pusher.

The present inverter 10 is operatively positioned between the infeed pusher 21 and the discharge conveyor 20 to receive successive sheet blocks 21 from the pusher, invert the received block, and position it for reception on the discharge conveyor 20.

A support frame 30 is provided to mount the present inverter 10 and the discharge conveyor 20 adjacent the pusher 21. It mounts the two units 10 and 20 for pivotal movement about a common first pivot axis A (shown in end view in FIG. 2). Appropriate bearings 31 are provided on opposite ends of the frame 30 for this purpose.

The inverter 10 includes an inverter yoke 35, mounted to the frame 30 for pivotal movement about the axis A. Yoke 35 includes bearings 36 that pivotably support a sheet block receiving magazine 40 with opposed sheet block receiving surfaces 41 thereon. The bearings 36 define a second axis B (also shown in end view in FIG. 2) about which the magazine 40 pivots. Second axis B is advantageously parallel to the first axis A.

Figure 4:
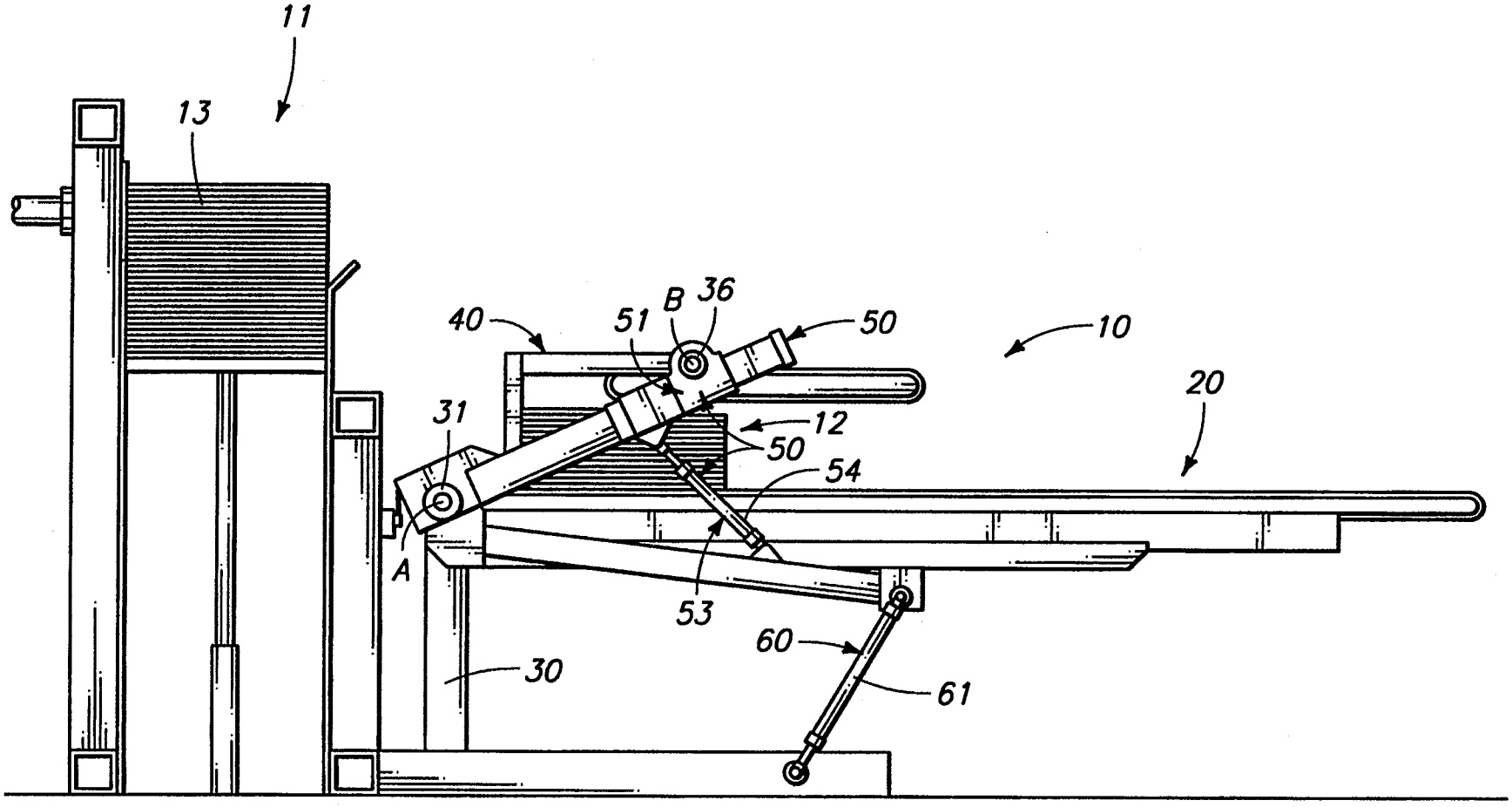
FIG. 4 is a view similar to FIG. 3, only showing complete inversion of the sheet block on the inverter.
Figure 11:
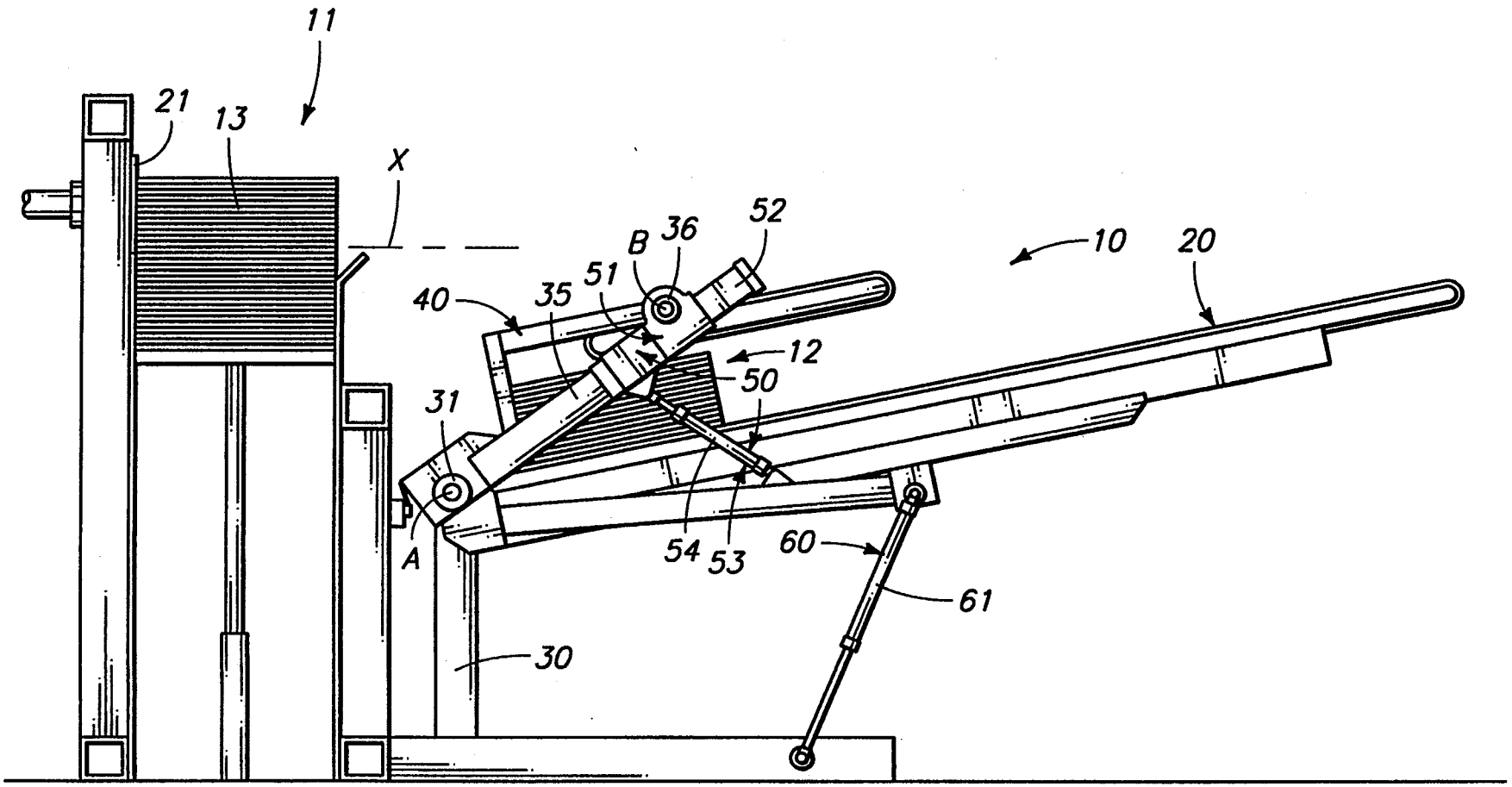

A driver 50 is mounted between the inverter yoke 35, the sheet block receiving magazine 40, and the frame for the discharge conveyor 20. The driver 50 is provided to angularly pivot the inverter yoke 35 and sheet block magazine between an elevated sheet block receiving position (FIG. 2) and a lowered sheet block discharge station (FIGS. 4 and 5). This is done in a two step process as will be described below.

Driver 50 includes a magazine pivot driver 51 comprised of a conventional cylinder rack and pinion pivot mechanism 52. The pivot mechanism 52 is mounted at one end of the yoke 35 and magazine 40 and are operable to pivot the magazine 40 through an angle about axis B that is less than 180°. Preferably, the angle of movement is approximately 160°, from the infeed plane x at the sheet block receiving position shown in FIG. 2, to the intermediate position shown in FIG. 3.

Driver 50 also includes a yoke pivot driver 53, comprised of a pair of double acting cylinders 54 mounted between the discharge conveyor frame and the inverter yoke 35. The cylinders 54 function to pivot the yoke 35, and attached magazine 40 through an angle of less than 90° and more preferably approximately 20° about the first axis A. This angular movement is exemplified by FIGS. 3 and 4.

Figure 3:
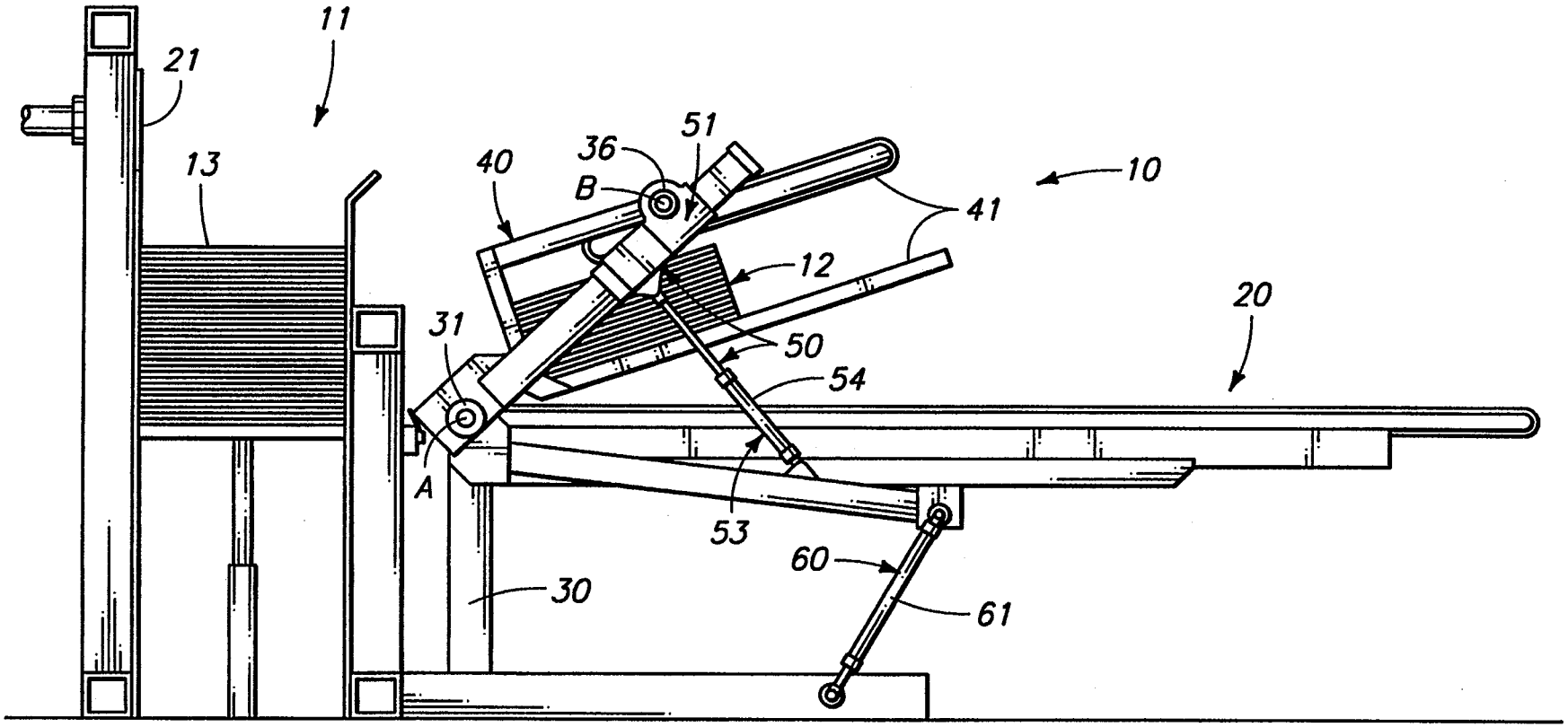
FIG. 3 is a view similar to FIG. 2, only showing partial inversion of the sheet block received on the inverter.

The driver 50 thus is comprised of the magazine pivot driver 51 and the yoke pivot driver 53. The two drivers 51, 53 function together to effectively pivot the block receiving magazine between the block receiving position (FIG. 2) and the block discharge station (FIG. 4). This is done in two successive pivotal movements as shown by FIGS. 2–4.

It is noted that the yoke and magazine are mounted coaxially with the infeed end of the discharge conveyor 20. This enables the yoke, magazine, and discharge conveyor to remain in the same angular relationship regardless of the angle of the conveyor to the floor or ground surface. This feature is demonstrated in FIG. 5 where all three mechanisms are shown lifted angularly upward from the orientation shown in FIG. 4. Since all three mechanisms move together, no adjustment of the magazine pivot drivers is necessary to compensate for elevational angular adjustment of the discharge conveyor. The adjustments take place automatically as the discharge conveyor is elevated. Double acting cylinders 54 compensate for angular adjustment of the discharge conveyor when the magazine is in the block receiving position. This is accomplished by appropriate sensors or limit switches commonly known in the industry.

The angular adjustment of the discharge conveyor 20 is accomplished about the first axis A by provision of a conveyor lift 60. Lift 60 is advantageously provided as double acting cylinders 61 at opposed ends of the frame 30. Each cylinder is mounted between the discharge conveyor frame and the support frame 30. Extension and retraction of the cylinders 61 will cause corresponding movement of the discharge conveyor about the first axis A.

In operation, a sheet block 12 is received on the adjacent support surface 41 of the sheet block receiving magazine 40 as the pusher operates to move the block horizontally from the top surface of the stack along the infeed plane x. Here the magazine is elevated and pivoted to the sheet block receiving position and the support surfaces are substantially coplanar with the infeed axis x.

Next, the magazine driver 51 is operated to pivot the magazine and the sheet block received thereon about the second axis B. The magazine pivot driver 51 first pivots the magazine and sheet block received thereby about the second axis B from the infeed plane x through the approximate angle of 160°. This leaves the sheet block almost inverted and slightly inclined upwardly as shown in the intermediate position in FIG. 3. There is little likelihood that the block of sheets will be ejected from the magazine when inclined as shown, and the pivotal motion can take place quite rapidly.

The yoke pivot driver 53 next functions to lower the magazine and sheet block gently about the first axis A the rest of the way (through an angle of approximately 20°) to the sheet block discharge station in the plane of the working flight of the discharge conveyor 20. The yoke pivot driver may advantageously be operated at a slower rate than that of the magazine pivot driver, to avoid disruption of the sheet block as it is lowered onto the discharge conveyor.

The discharge conveyor 20 is now able to receive and move the block from the magazine toward the conveyor discharge end. This completes the delivery portion of the operational cycle. Next, the magazine and yoke pivot drivers function simultaneously in reverse to pivot and elevate the magazine back to the sheet block receiving position (FIG. 2) ready to receive the next successive block of sheets from the pusher.

In compliance with the statute, the invention has been described in language more or less specific as to methodical features. It is to be understood, however, that the invention is not limited to the specific features described, since the means herein disclosed comprise preferred forms of putting the invention into effect. The invention is, therefore, claimed in any of its forms or modifications within the proper scope of the appended claims appropriately interpreted in accordance with the doctrine of equivalents.

I claim:

1. A sheet block inverter for inverting a block of sheets fed along an infeed plane, comprising:

a support frame;

an inverter yoke mounted to the support frame for pivotal movement about a first axis;

a sheet block discharge conveyor mounted to the support frame for pivotal movement about the first axis, coaxially with the inverter yoke;

a sheet block receiving magazine with a sheet block receiving surface thereon, mounted to the inverter yoke for pivotal motion thereon about a second axis between a sheet block receiving position wherein the sheet block receiving surface is substantially parallel to the infeed plane and a sheet block stop position; and driver means for angularly pivoting the inverter yoke and the sheet block receiving magazine between an elevated sheet block receiving station and a lowered sheet block discharge station.

2. The sheet block inverter as claimed by claim 1 further comprising a discharge conveyor lift for pivoting the sheet block discharge conveyor about the first axis.

3. The sheet block inverter as claimed by claim 1 wherein the first and second pivot axes are parallel to each other.

4. The sheet block inverter as claimed by claim 1 wherein the driver means includes a magazine pivot driver on the inverter yoke for pivoting the sheet block receiving magazine through an angle less than 180° from the sheet block receiving position.

5. The sheet block inverter as claimed by claim 1 wherein the driver means includes:

a magazine pivot driver for pivoting the sheet block receiving magazine through an angle less than 180° from the sheet block receiving position, and a yoke pivot driver for pivoting the inverter yoke about an angle less than 90°.

6. The sheet block inverter as claimed by claim 1 wherein the driver means includes a magazine pivot driver for pivoting the sheet block receiving magazine through an angle of approximately 160° from the sheet block receiving position to the sheet block stop position.

7. The sheet block inverter as claimed by claim 1 wherein the sheet block discharge conveyor is mounted to the support frame for angular pivotal movement coincidental with the inverter yoke and sheet block receiving magazine.

8. A sheet block inverter for inverting a block of sheets fed along an infeed plane, comprising:

a support frame;

a sheet block discharge conveyor mounted to the support frame for pivotal movement about a first axis;

an inverter yoke mounted to the support frame for pivotal movement about said first axis;

a sheet block receiving magazine with a sheet block receiving surface thereon, mounted to the inverter yoke for pivotal motion thereon about a second axis parallel to and spaced from said first axis between a sheet block receiving position wherein the sheet block receiving surface is substantially parallel to the infeed plane and a sheet block discharge station angularly spaced about the second axis from the infeed plane;

a magazine pivot driver operatively mounted between the inverter yoke and sheet block receiving magazine for pivoting the sheet block receiving magazine through an angle about the second axis of less than 180° from the sheet block receiving position; and an inverter yoke driver operatively mounted between the inverter yoke and the support frame for angularly pivoting the inverter yoke and the sheet block receiving magazine about the first axis through an angle of less than 90°.

9. The sheet block inverter as claimed by claim 8 wherein the magazine pivot driver pivots the sheet block receiving magazine through an angle about the second axis of approximately 160° from the sheet block receiving position.

10. The sheet block inverter as claimed by claim 8 wherein the inverter yoke driver pivots the inverter yoke and sheet block receiving magazine through an angle of approximately 20°.

11. The sheet block inverter as claimed by claim 8 wherein the magazine pivot driver pivots the sheet block receiving magazine through an angle about the second axis of approximately 160° from the sheet block receiving position; and wherein the inverter yoke driver pivots the inverter yoke and sheet block receiving magazine through an angle of approximately 20°.

* * * * *